US007854319B2

(12) United States Patent
Yau

(10) Patent No.: US 7,854,319 B2
(45) Date of Patent: Dec. 21, 2010

(54) MULTIFUNCTIONAL COVER DEVICE WITH A DETACHABLE PDA DEVICE

(76) Inventor: Yimwai Yau, RM 611, South BLK, Shangbu Industry & Commerce Building, Zhenxing Road, Futian, Shenzhen (CN)

( * ) Notice: Subject to any disclaimer, the term of this patent is extended or adjusted under 35 U.S.C. 154(b) by 807 days.

(21) Appl. No.: 11/792,446

(22) PCT Filed: Dec. 5, 2005

(86) PCT No.: PCT/CN2005/002093

§ 371 (c)(1),
(2), (4) Date: Jun. 5, 2007

(87) PCT Pub. No.: WO2006/060954

PCT Pub. Date: Jun. 15, 2006

(65) Prior Publication Data

US 2008/0252063 A1 Oct. 16, 2008

(30) Foreign Application Priority Data

Dec. 9, 2004 (CN) ..... 2004 1 0052572

(51) Int. Cl.
*B42D 3/12* (2006.01)
*B42F 13/40* (2006.01)

(52) U.S. Cl. ..... 206/320; 206/701; 206/472; 206/486

(58) Field of Classification Search ..... 206/472, 206/701, 486, 320; 281/31, 29; 361/679.3; 402/73, 70, 80 R
See application file for complete search history.

(56) References Cited

U.S. PATENT DOCUMENTS 7,281,877 B1 * 10/2007 Lederer et al. ..... 402/73

* cited by examiner

*Primary Examiner*—Ehud Gartenberg
*Assistant Examiner*—Kaushikkumar Desai
(74) *Attorney, Agent, or Firm*—Raymond Y. Chan; David and Raymond Patent Firm

(57) ABSTRACT

A multifunctional cover device with a detachable PDA device includes a front cover, a back cover, and at least one rotatable accessory panel connected to the front cover at one side for holding the PDA device and a lighting lamp. The accessory panel is mounted at a concave surface of the front cover when it is folded and at this time, the lamp and the PDA device are aligned with the windows of the front cover. When the accessory board is rotated through 180 degrees from the concave surface of the front cover, it forms an extending front cover panel. According to another structure, the accessory board is slidably mounted in the hollow front cover. Therefore, the user is able to use the PDA device while reading and writing with illumination and sound by playing the PDA device.

6 Claims, 20 Drawing Sheets

MULTIFUNCTIONAL COVER DEVICE WITH A DETACHABLE PDA DEVICE

BACKGROUND OF THE PRESENT INVENTION

1. Field of Invention

The present invention relates to a cover device for media, office work, or study, and more particularly to a multifunctional cover device, wherein a PDA device is detachable on an extendable accessory panel of the multifunctional cover device with the functions of playing sound and illumination.

2. Description of Related Arts

With development of digital technology, there are many products in the market associated with PDA (Personal Digital Assistant), a hand-held micro computer. This hand-held micro computer is popular because it is small in size, easy to carry, capable of storing huge amount of information and multifunctional. The PDA devices totally serve the needs in our modern and highly developed society and fulfill people's needs in several aspects such as office work and study. Office tools, such as folding notebooks and binders, are often be used in our daily life. People usually need to write down the notes while looking for information. However, existing personal micro computers are usually separated from notepads. It is inconvenient for people to simultaneously bring the notepads and the personal micro computers to serve the needs of work and study. On the other hand, people feel so limited when using existing notepads, binders or information booklets because the covers thereof are fixed flat-piece structure. With the development of the society, people need huge amount of information during work and study, and it is very inconvenient for them to carry huge bags to work or school.

SUMMARY OF THE PRESENT INVENTION

To solve the problems stated above, the present invention provides a multifunctional cover device with an extendable ability for detachably holding a PDA device thereat, so that information reading and notes taking can be done simultaneously, and the multifunctional cover device which provides a lighting lamp and a speaker for playing the sound in the PDA.

To achieve the goals stated above, the present invention provides a multifunctional cover device for PDAs, wherein the device comprises a front cover and back cover, and has features that the front cover with a concave surface is connected to at least one rotatable accessory panel which can be connected to either side of the front cover, wherein the rotatable accessory panel forms an extendable front cover by rotating 180 degrees from inside (i.e. the concave surface) to outside of the front cover. A lighting lamp and a device are connected to the accessory panel for detachably mounting the PDA thereon, and the protruding part of the lighting lamp and the device are placed in the window on the front cover when the accessory panel is restored and folded.

A hinge with through hole is placed at each of the top and bottom of the connecting ends of the accessory panel, wherein a hole corresponding to the hinge is located on each of the upper and lower lateral walls of the concave surface of the connecting ends of the front cover. The upper and lower ends of the accessory panel are rotatably connected with the lighting lamp and the front cover, wherein the inner side of the concave surface of the front cover has an indenture used to pull out the accessory panel.

The lighting lamp is in a planar lamp set in which the upper and lower connecting ends are rotatably connected with the accessory panel and the front cover through the hinges with through holes and the connecting holes. The lighting lamp is connected with the battery set in the connecting edge panel located between the front and the back cover.

Another structure in the present invention includes the front and back covers, wherein a pull-and-push accessory panel is located at the front cover which is hollow inside. An exit for the accessory panel is placed on one side or multiple sides of the front cover and the accessory panel can be pulled out to form an extendable front cover and restored into the front cover after use. A rotatable lighting lamp and a mounting device are formed on the accessory panel, and the protruding parts of the lighting lamp and PDA devices are placed in the window of the front cover when the accessory panel is in its restored position.

A position column with through hole is each placed at the upper and lower lateral wall of the inner chamber of the front cover, wherein a corresponding elongated groove is formed at each of the top and bottom ends of the accessory panel. Extendable position of the accessory panel is limited by the position columns. A protruding column is placed at the edge of the extension end of the accessory panel, while an indenture for pulling out the accessory panel is at the edge of the exit of the front cover.

The back cover is planar and hollow shape, wherein an amplifier located at the corner of the back cover and connected with the battery set is protruding inwardly with the thickness corresponding to that of the connecting edge panel for the front and back covers. The shape of the front cover and information booklets accords with that of the connecting part of the amplifier, and magnetic pieces used for magnetic attraction are placed face to face on the front cover and the amplifier.

A plurality of decorative illuminators is placed at the outer surface of the front cover, wherein the illuminators are connected with the circuit board which is connected to the battery set. The circuit board is inside the front cover and the computer ports thereon are designed to connect the circuit board and computers for information exchange.

There is a through window on the accessory panel. At least two sets of retractable metal connecting columns for electronic connections are placed on the upper and lower lateral wall of the window. PDA devices have connecting holes on the upper and lower edges for the metal connecting columns to plug in, wherein the metal connecting columns can detachably connect PDA devices.

The metal connecting column comprises two column sections and a supporting board connecting between the column sections. Two or more column seats, each having a seating hole, are mounted at a peripheral side of the through window, wherein one of the column sections is slidably disposed at the seating hole while another column section is slidably disposed in a column hole provided at an inner frame mounted to the through window. A spring is in the seating hole to bias against the supporting board towards the inner frame so as to push a portion of the respective column section out of the column hole, such that the column sections of the metal connecting column are freely moved at the column hole and the seating hole to selectively retract the portion of the column section back to the column hole. In other words, the metal connecting column can move up and down at the column hole and the seating hole of the accessory panel and the column seat.

Contribution of the present invention is that it changes the simple structure of traditional book covers and enables the front cover extendable through the accessory panel and places PDA devices and lighting lamps thereon, wherein the PDA devices on the accessory panel can be placed on the same surface as the information booklets so that the PDA devices and the information booklets can be used simultaneously and not interfere with each other, and it is convenient for the users. The present invention effectively combines traditional notebooks, binders and information booklets with PDA devices as a whole so that it not only increases the capability of information storage but also facilitates people to study and do office works. PDA devices are detachable in the present invention so as to serve the users' needs to adjust. In addition, the front cover of the present invention has sound-playing and illumination devices, and hubs for computer connections which make the present invention have more complete functions and easy to carry.

BRIEF DESCRIPTION OF THE DRAWINGS

FIG. 1 is a schematic representation of structure in embodiment 1, wherein

FIG. 2 is a structural schematic representation of components in embodiment 1, wherein

FIG. 3 is a structural schematic representation of embodiment 2, wherein

FIG. 4 is a structural schematic representation of embodiment 3, wherein

FIG. 5 is a schematic representation of components in embodiment 3, wherein

FIG. 6 is a structural schematic representation of connection between the PDA device and the accessory panel, wherein

DETAILED DESCRIPTION OF THE PREFERRED EMBODIMENT

The present invention is further explained and illustrated with following embodiments but the present invention is not limited thereby.

Embodiment 1

Figure 1A:
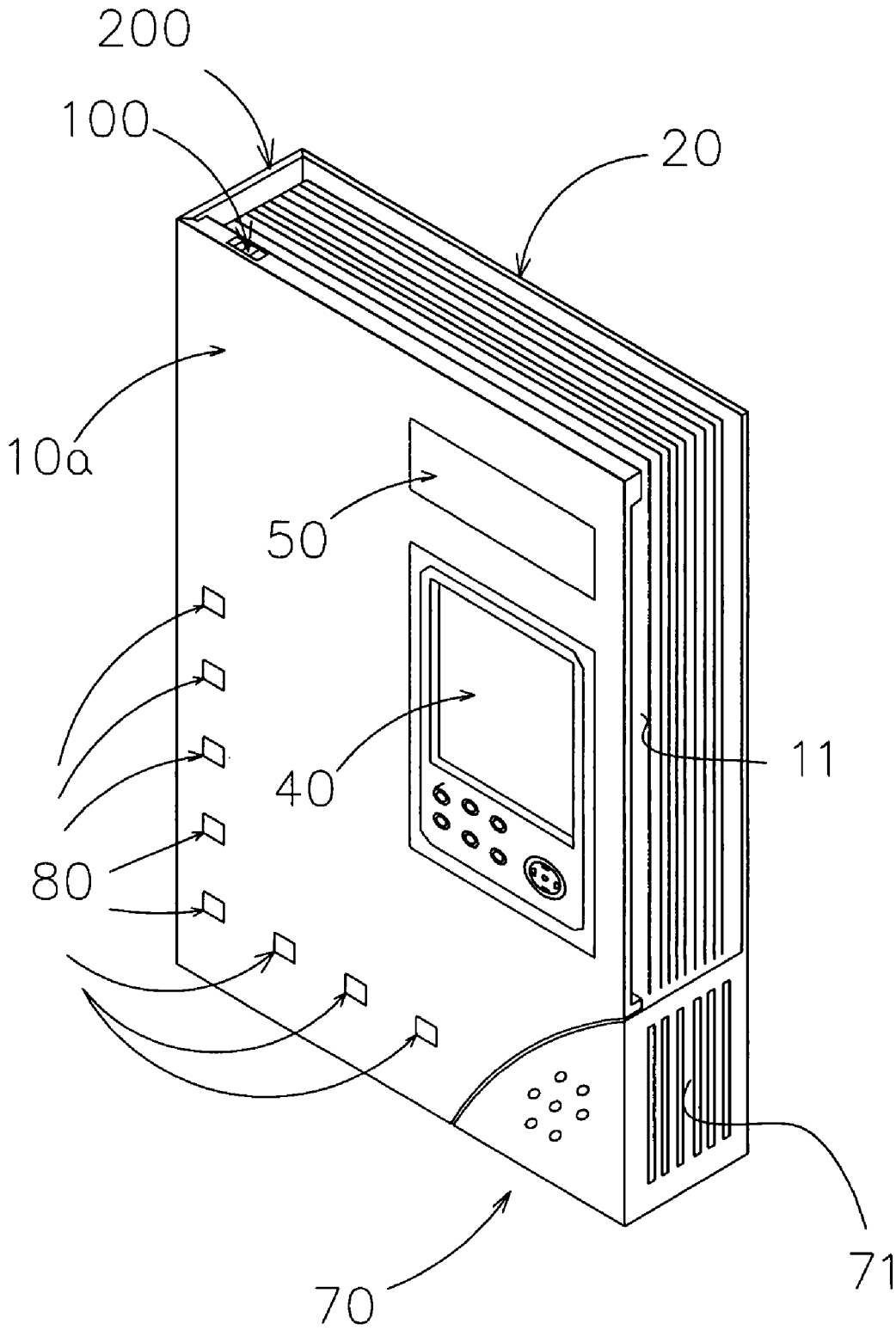
FIG. 1A is a schematic view of the outer main body.
Figure 1B:
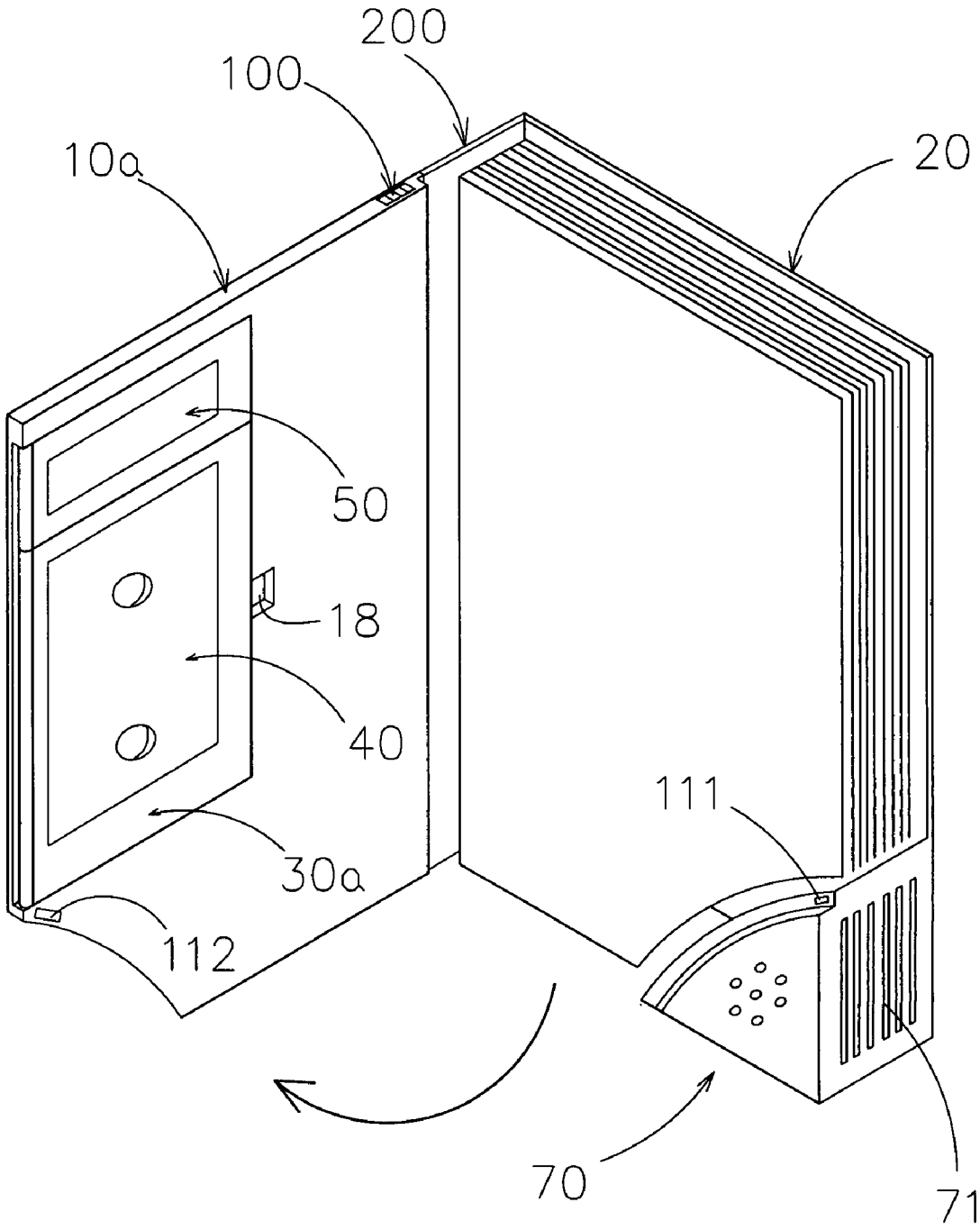
FIG. 1B is a schematic view illustrating the accessory panel being restored into the front cover.
Figure 1C:
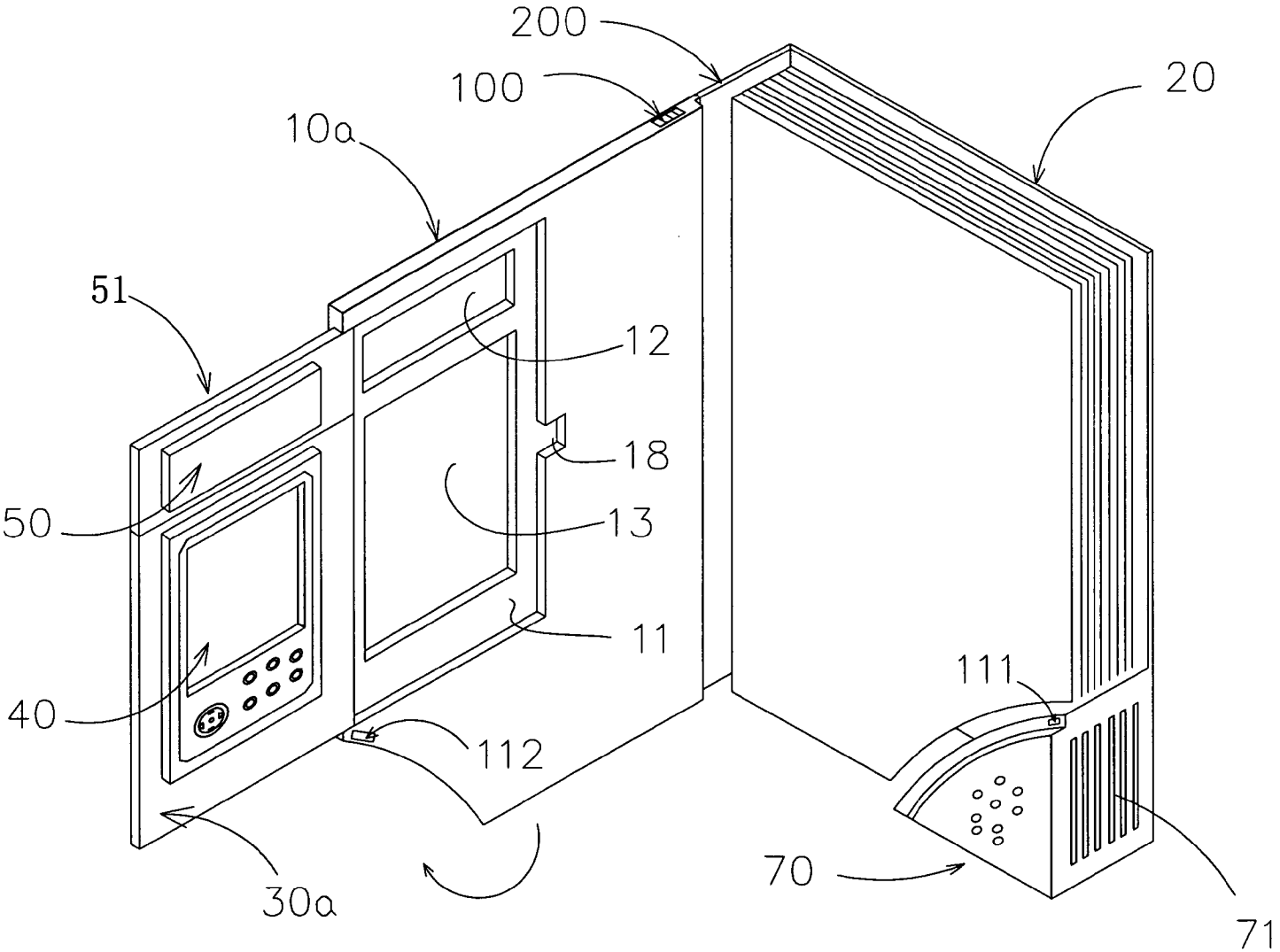
FIG. 1C is a schematic view illustrating the accessory panel being rotatably extended.
Figure 1D:
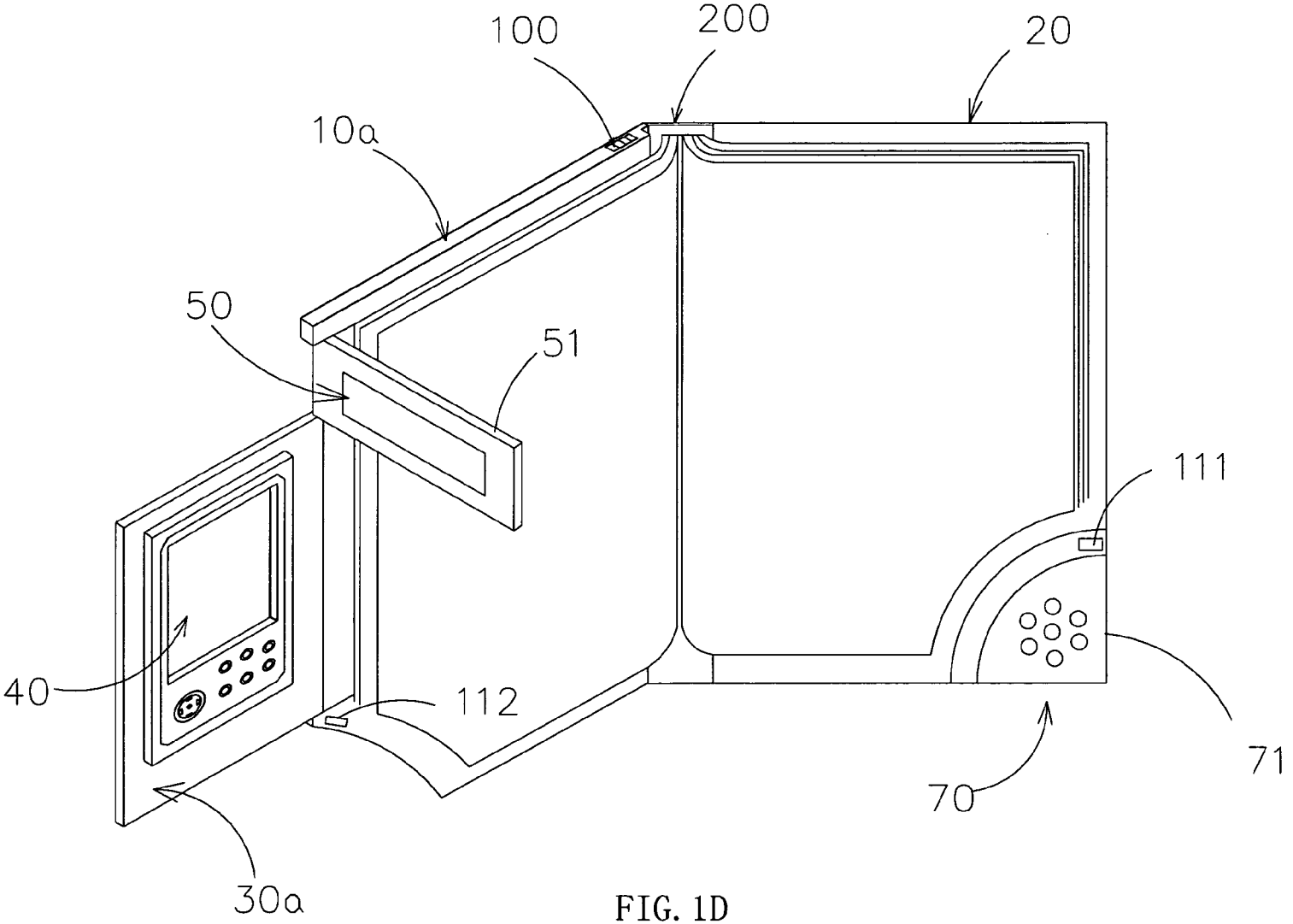
FIG. 1D is a schematic view illustrating a lighting lamp being in use.
Figure 2A:
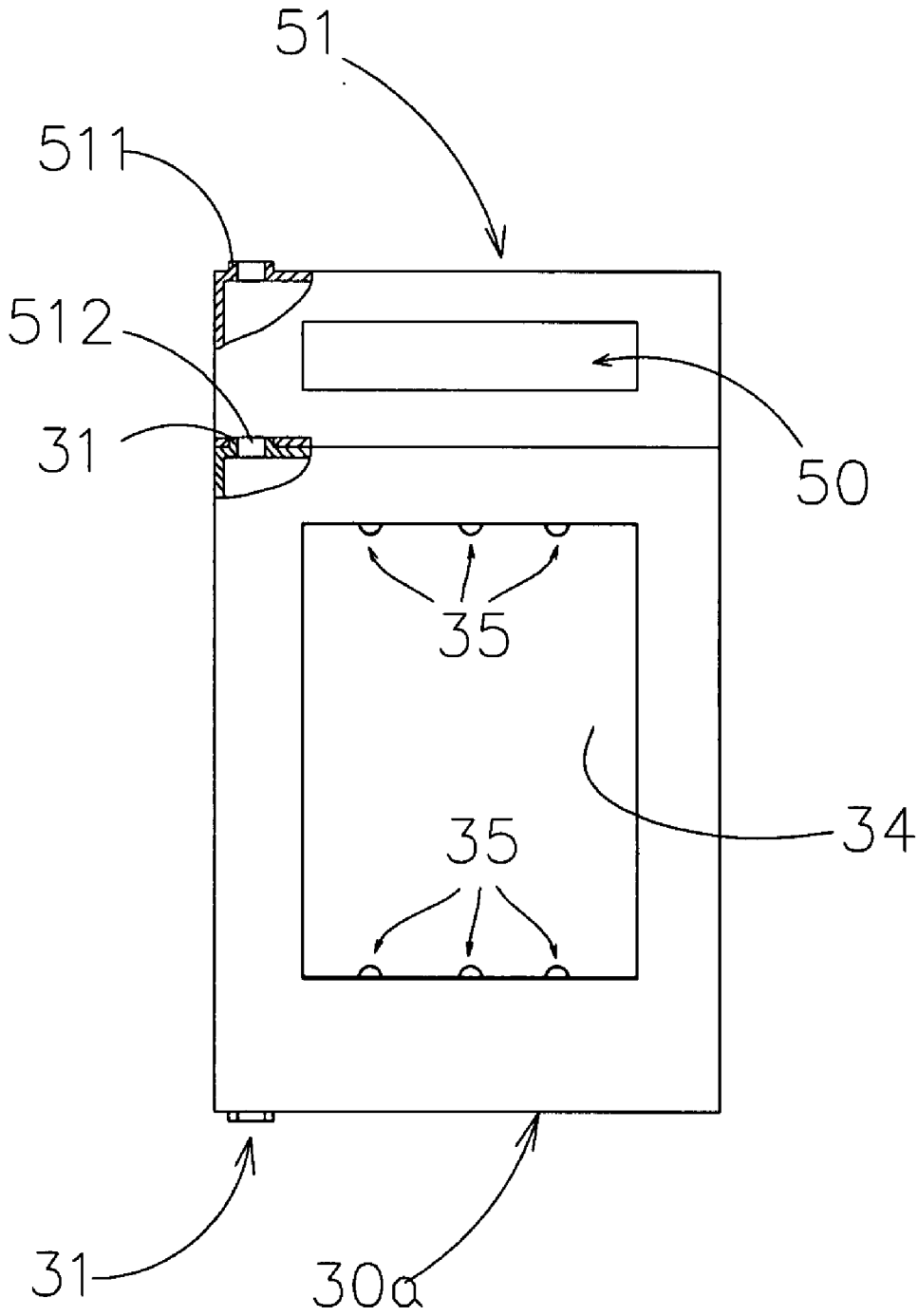
FIG. 2A is a structural schematic representation of the lighting lamp.
Figure 2B:
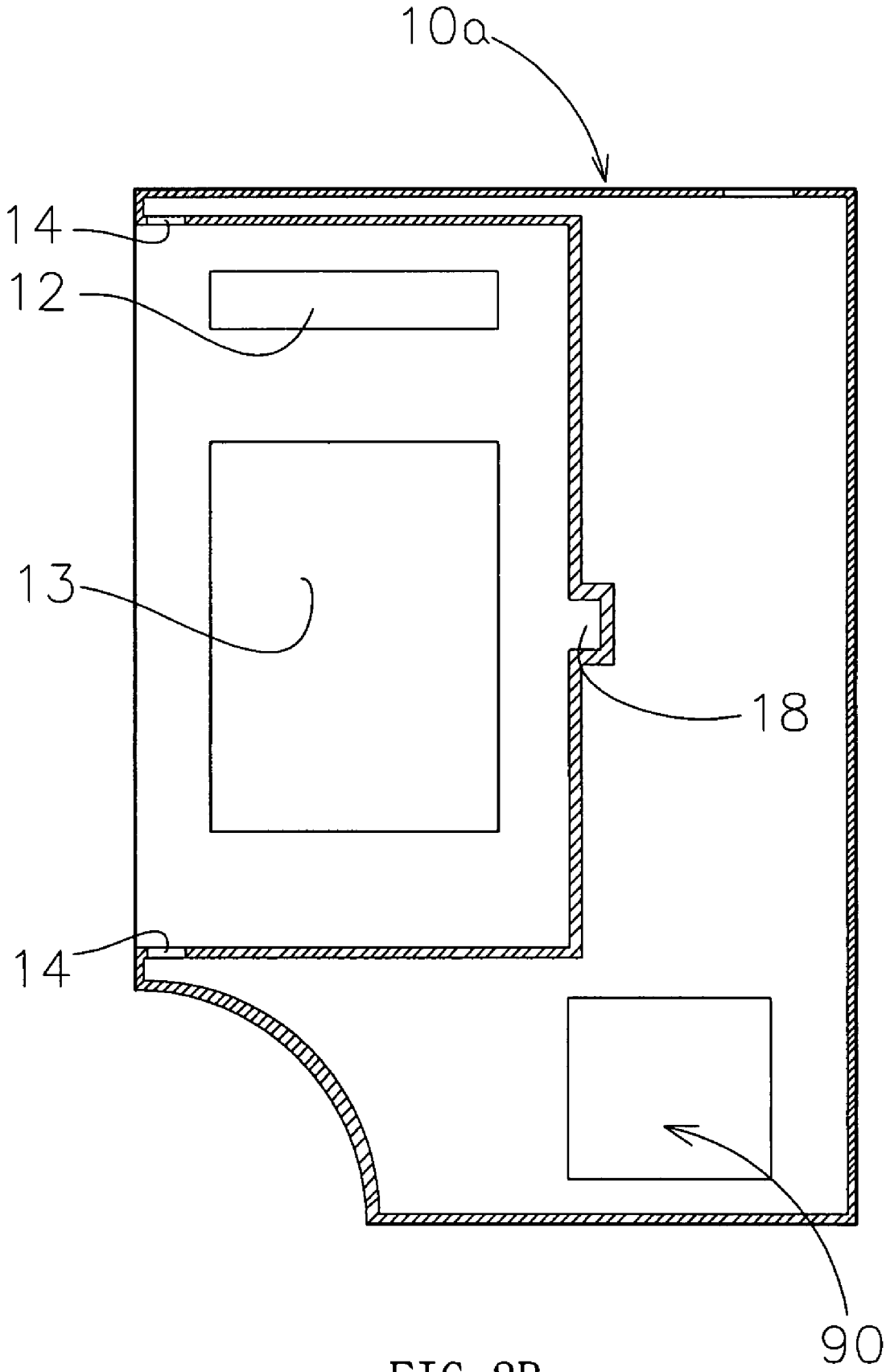
FIG. 2B is a structural schematic representation of the accessory panel.
Figure 4C:
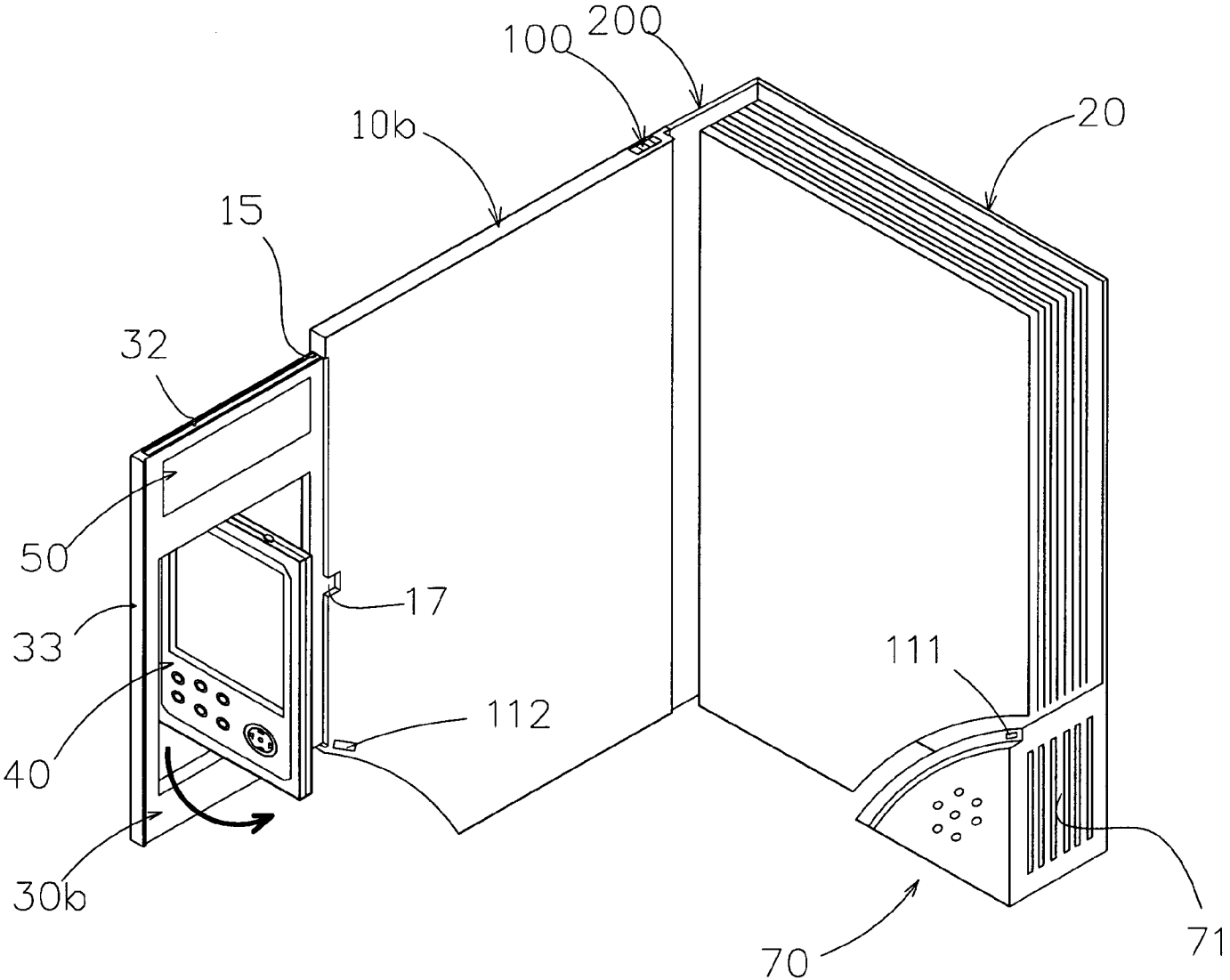
FIG. 4C is a schematic representation when a PDA device rotates.
Figure 4D:
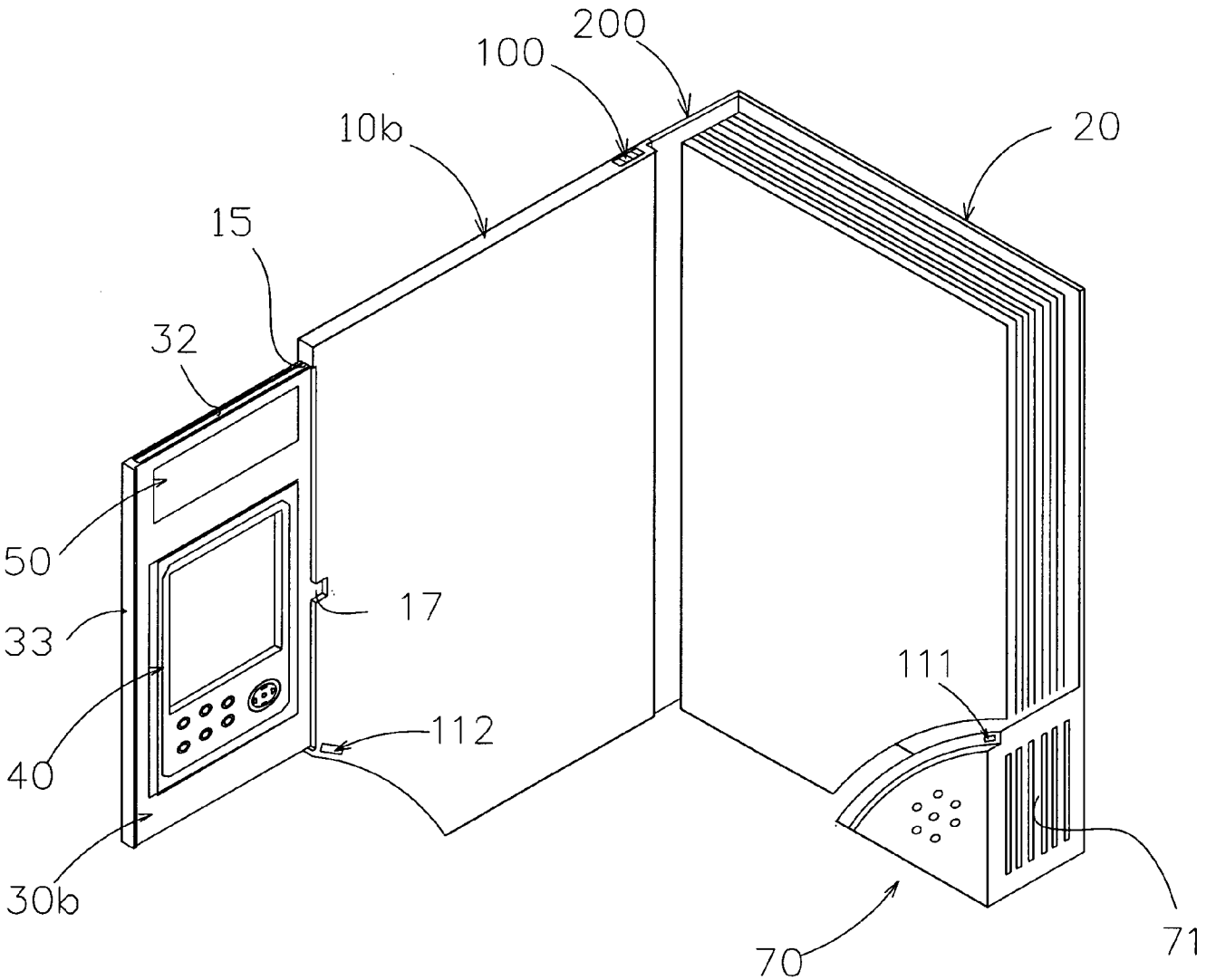
FIG. 4D is a three-dimension schematic representation after the PDA rotates.
Figure 4E:
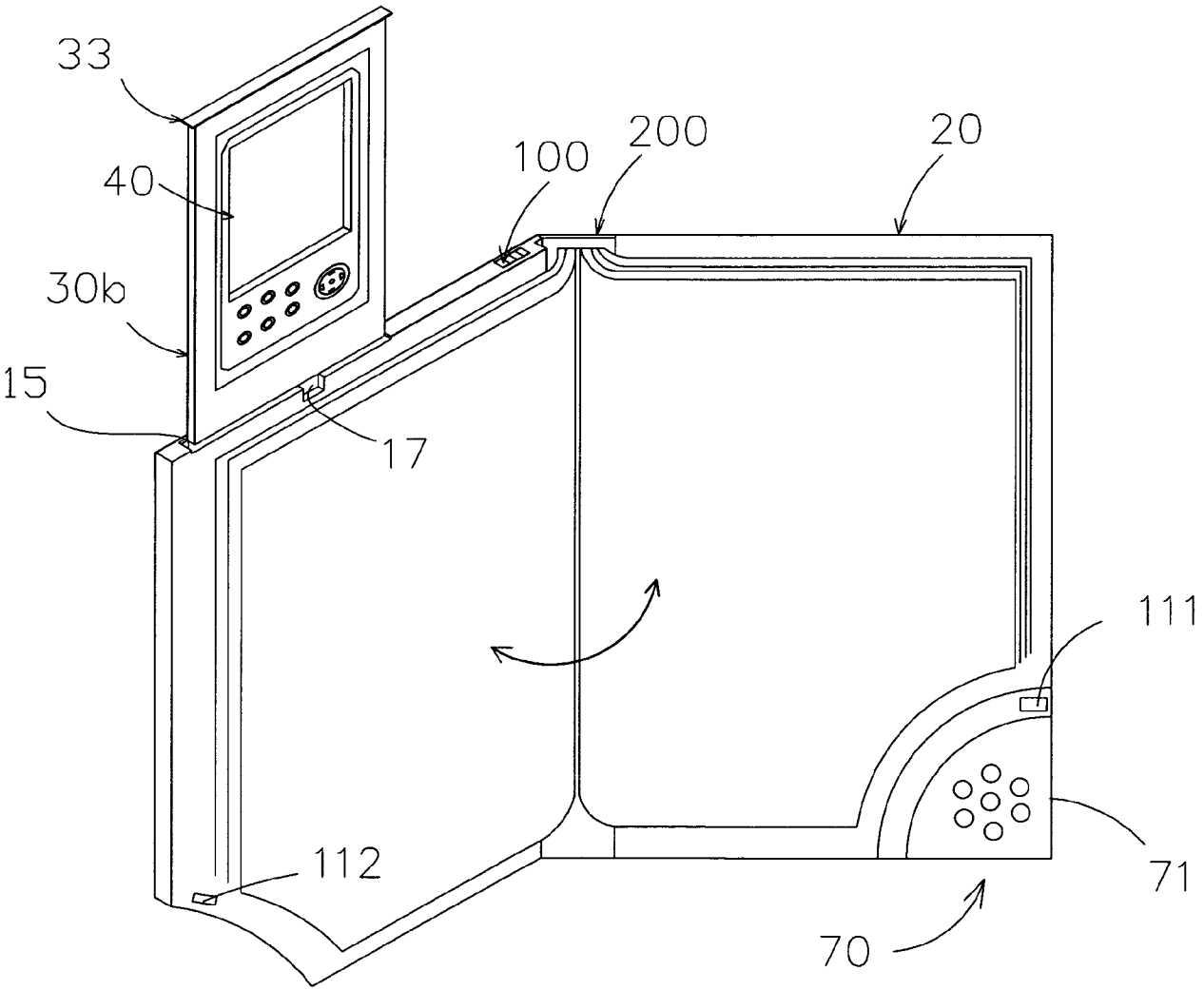
FIG. 4E is a structural schematic representation when the accessory panel is pulled upwards.
Figure 5A:
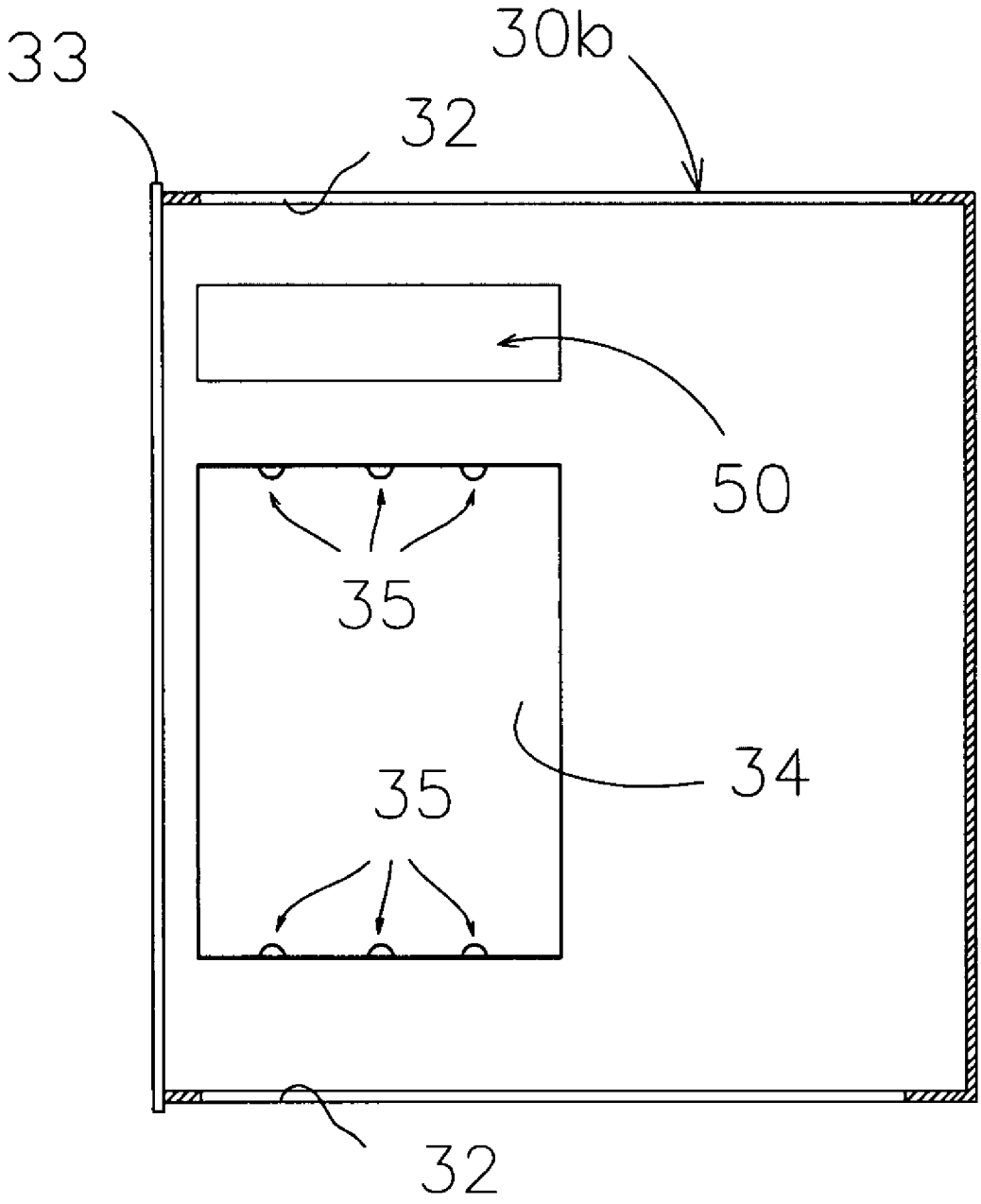
FIG. 5A is a structural schematic representation of the accessory panel.
Figure 5B:
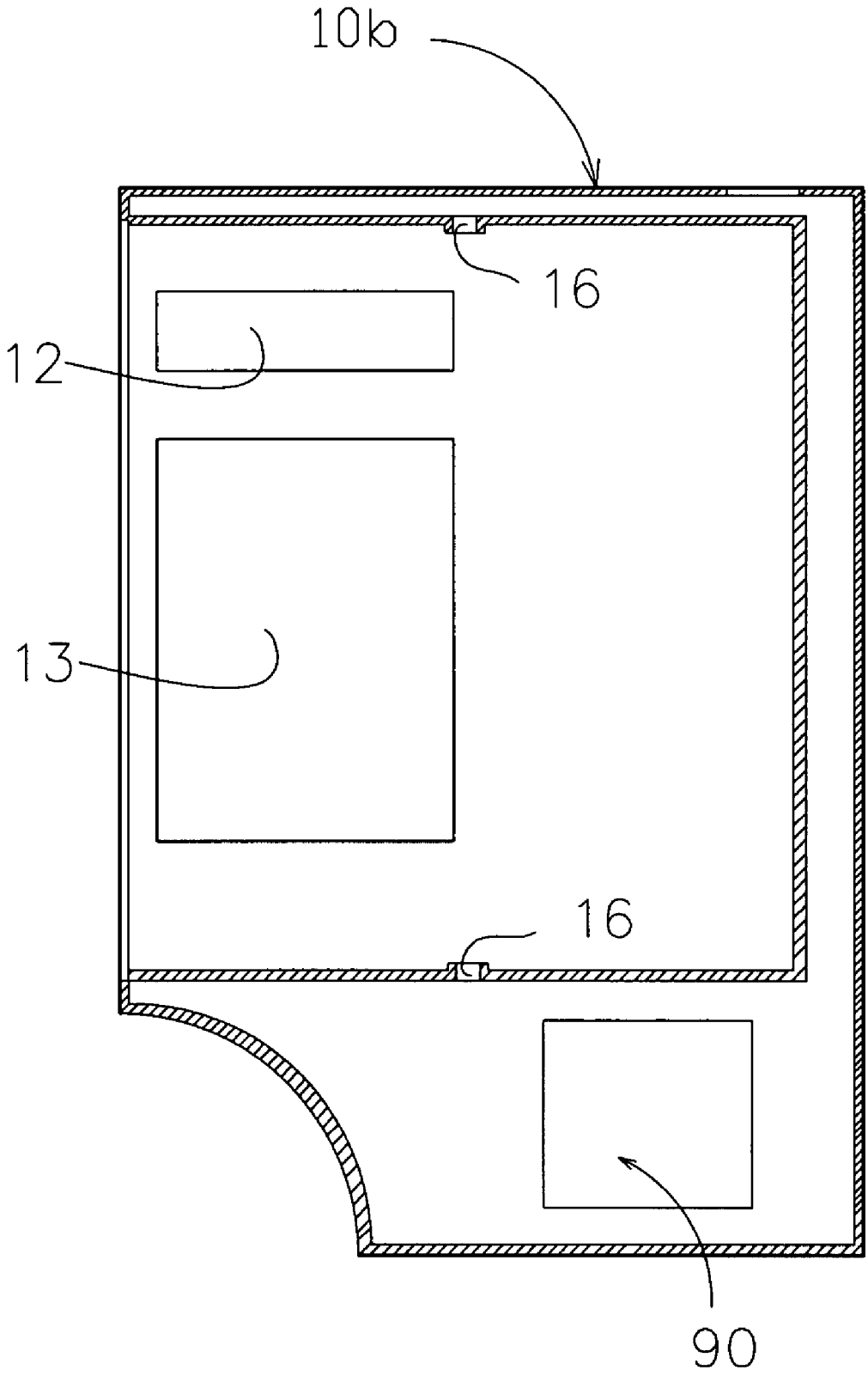
FIG. 5B is a structural schematic representation of the front cover.
Figure 5C:
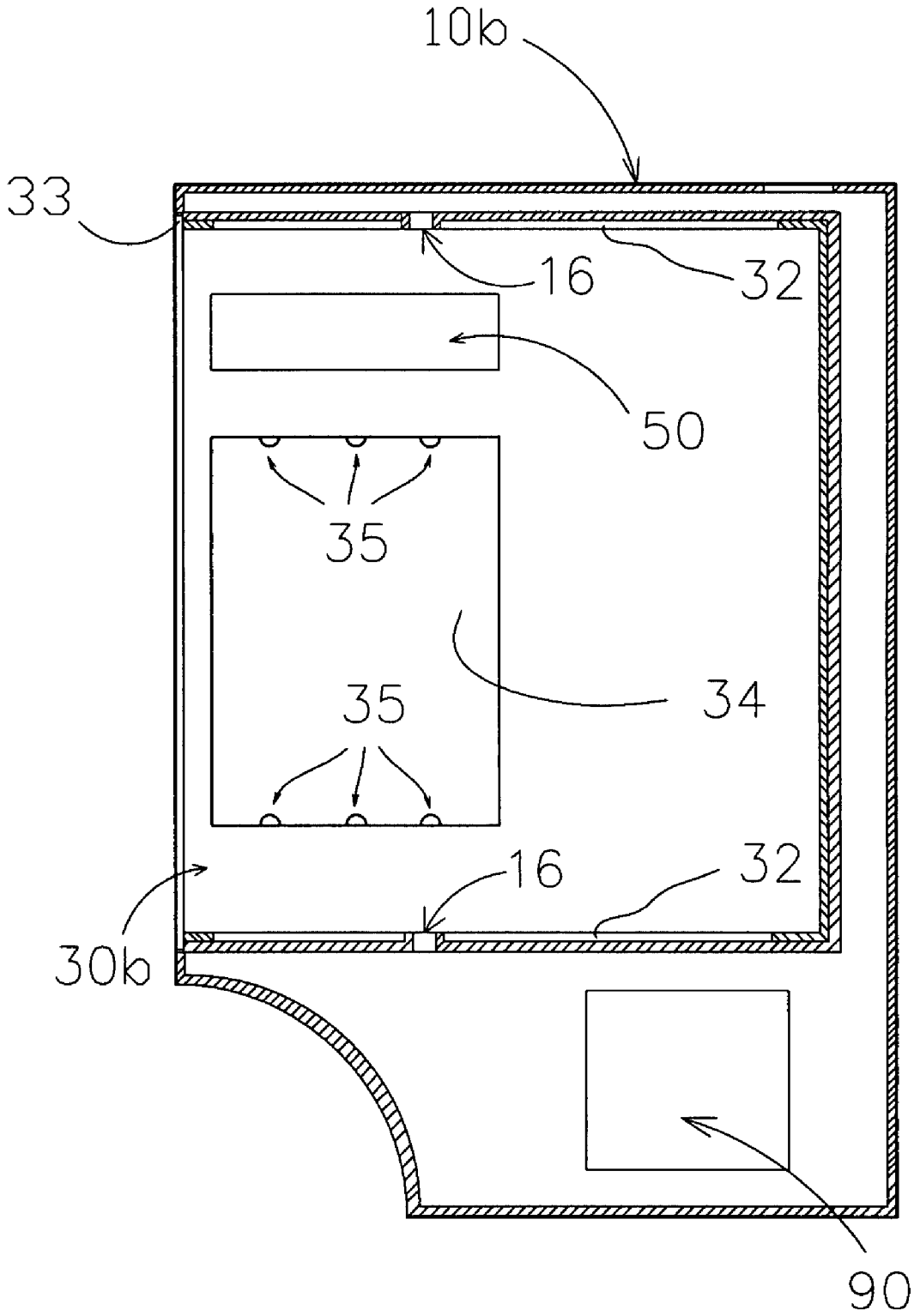
FIG. 5C is a schematic representation when the accessory panel is restored inside the front cover.
Figure 6A:
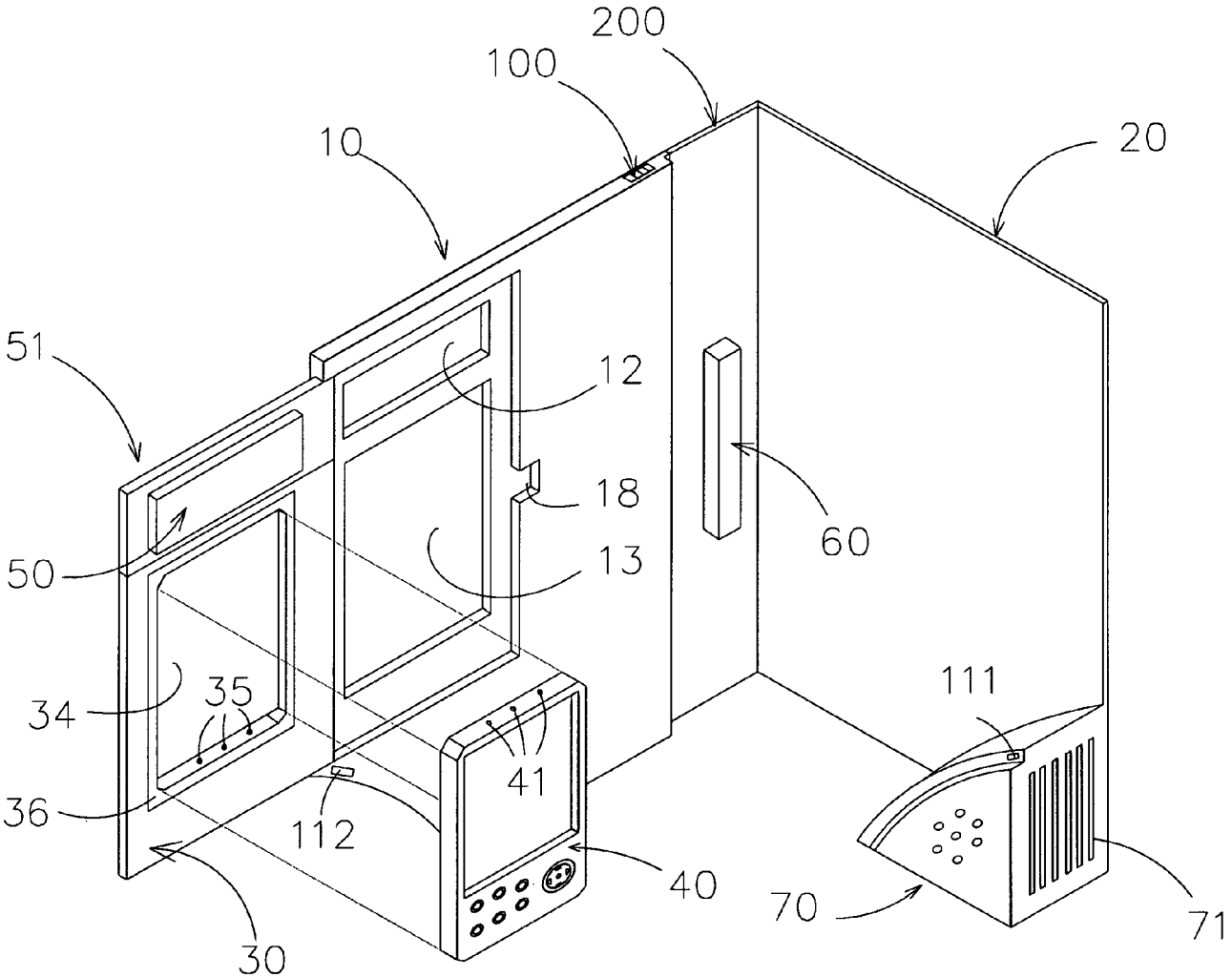
FIG. 6A is an exploded schematic representation of the PDA device and the components of the accessory panel.
Figure 6B:
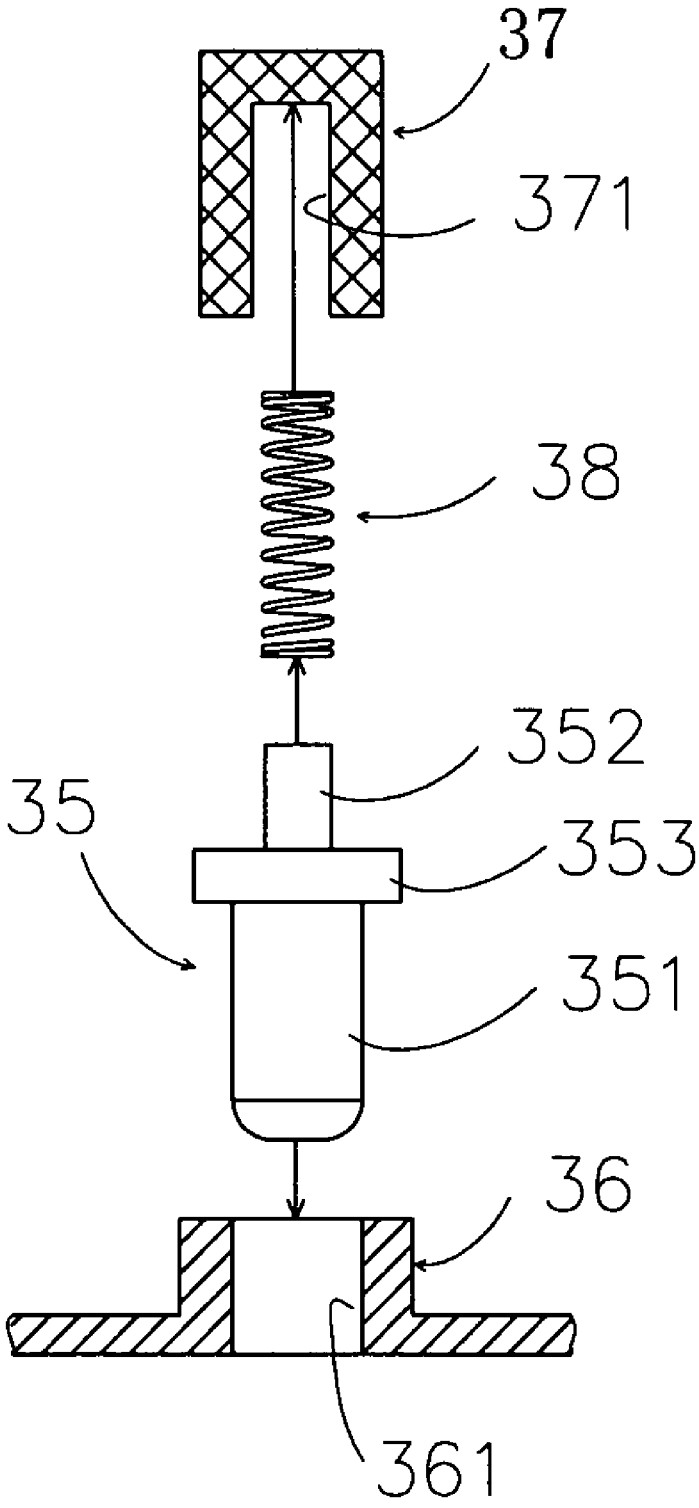
FIG. 6B is an exploded schematic representation of the components of a metal connecting column.
Figure 6C:
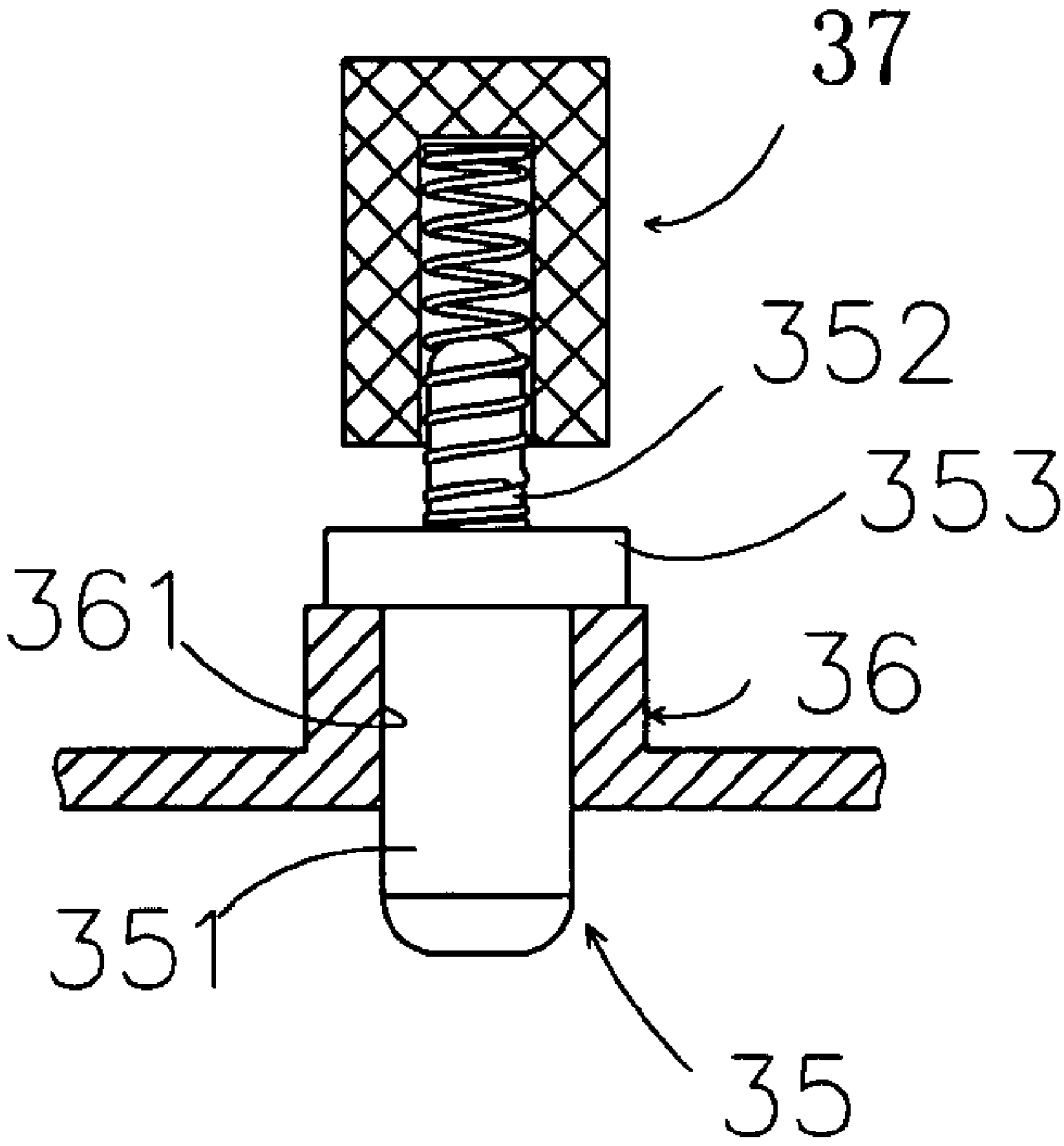
FIG. 6C is a structural perspective view of the metal connecting column.

A multifunctional cover device for PDA with a rotatable accessory panel is illustrated in this embodiment. Referring to FIG. 1 and FIG. 2, the cover device comprises a front cover 10*a* and a back cover 20, which are connected by connecting edge panel 200. Unlike traditional covers, front cover 10*a*, back cover 20 and connecting edge panel 200 are hollow slabs made by injection molding process. A concave surface 11 is located at the interior side of the front cover 10*a*. There is at least one rotatable accessory panel 30*a* foldably mounted on the concave surface 11 and the thickness of the rotatable accessory panel 30*a* is the same as the depth of the concave surface of the front cover 10*a*. A hinge through hole is formed at each of the top and bottom edge of the accessory panel 30*a* to pivotally connect the accessory panel 30*a* on the front cover 10*a* through a hinge axle 31, as shown in FIG. 2A. The cables are extended through the hinge through hole to operatively connect to PDA devices. A hole 14 is formed at each of the upper and lower lateral walls of the concave surface 11 of the connecting end of the front cover 10*a*, as shown in FIG. 2B, to align with the hinge axle 31. The upper and lower ends of the accessory panel 30*a* are foldably connected to the lighting lamp 50 and the front cover 10*a* respectively to form a rotatable connection through the hinge axle 31. The front cover 10*a* further has two windows 12, 13 to alignedly receive the lighting lamp 50 and the PDA device respectively. An indenture 18 is formed at an inner edge of the concave surface 11 of the front cover 10*a* for a finger of a user to pivotally pull out the accessory panel 30*a* easily. When the PDA device is not in use, the accessory panel 30*a* can be fittingly place in the concave surface 11 of the front cover 10*a*, so that the overall thickness of the cover device can be effectively reduced. When the PDA device is in use, the accessory panel 30*a* can be foldably and outwardly rotated of 180 degrees via the indenture 18 and forms an identical surface with the front cover 10*a*, such that the accessory panel 30*a* forms an extension of the front cover 10*a*, as shown in FIG. 1C and FIG. 1D. Referring to FIGS. 5A, and 6A, there is a through window 34 on the accessory panel 30*a* or 30*b*, and three sets of retractable metal connecting columns 35 used for electrical connections are located at the upper and lower lateral wall of the through window 34. The upper and lower lateral sides of the PDA device 40 have connection holes 41 used for the outputs of the PDA device when the metal connecting columns 35 plugs in. The PDA device 40 is detachable connected to the metal connecting columns 35 within the through window 34, wherein the front surface of the PDA device 40 is higher than the surface of the accessory panel as shown in FIG. 1C, so that the protruding part of the lighting lamp 50 and the detachable PDA device is placed in the windows 12 and 13 on the front cover when the accessory panel is restored to its original position, as shown in FIGS. 1A and 1B. Referring to FIGS. 6B and 6C, each of the metal connecting columns 35 comprises two column sections 351, 352 and a supporting board 353 connecting between the column sections 351, 352. Two or more column seats 37, each having a seating hole 371, are mounted at a peripheral side of the through window, wherein one of the column sections 352 is slidably disposed at the seating hole 371 while another the column section 351 is slidably disposed in a column hole 361 provided at an inner frame 36 mounted to the through window. A spring 38 is in the seating hole 371 to bias against the supporting board 353 towards the inner frame 36 so as to push a portion of the respective column section 351 out of the column hole 361, such that the column sections 351, 352 of the metal connecting column 35 are freely moved at the column hole 361 and the seating hole 371 to selectively retract the portion of the column section 351 back to the column hole 361. In other words, the metal connecting columns 35 can move up and down in the column hole 361 of the inner frame 36 of the accessory panel 30*a* or 30*b* and the seating hole 371 of the column seats 37. Because the metal connecting columns 35 are retractable, the PDA device 40 is very easy to be detached and turned. Its turning positions are shown as FIGS. 4C and 4D. When opening the information booklets of the front cover in the present invention, if the user needs to look up the information in the PDA device at the same time, the accessory panel 30 can be rotated to the exterior side of the front cover, so that the PDA device can face the user directly and it is thus convenient for the user. In order to provide illumination for people reading and writing with insufficient light, a lighting lamp 50 is connected to the accessory panel 30 as shown in FIGS. 1D and 2A. The lighting lamp 50 can be a fluorescent tube or a lamp, located in a planar lamp set 51 in which the upper and lower connecting ends are rotatably connected with the accessory panel 30*a* and front cover 10*a* through a hinge 511 (with through holes) and connection holes 512. Connecting cable of the lighting lamp 50 is connected with a battery set 60 by passing the through holes of the hinge 511, wherein the battery set is located inside a connecting edge panel 200 which is used to connect front cover 10 and back cover 20 as shown in FIG. 6A, and the batteries on the battery set supply electro-power to the lighting lamp. As illustrated in FIG. 1D, the illumination angle can be adjusted by rotating the lamp set 51 if necessary. A plurality of illuminators 80 is on the outer surface of the front cover 10*a* and the illuminators are LEDs which can be decorative. The LEDs are connected with the circuit board 90 which is connected to the battery set 60 as shown in FIGS. 2B, 5B and 5C, and is located inside the front cover. Computer connection ports 100, as shown in FIG. 1A, which are used to connect with the circuit board 90 are located on the rim of the front cover 10*a*. Information can be exchanged and transmitted from the PDA to external computers through the computer connection ports. The back cover 20 is a hollow and planar shape. An amplifier 70 located at the corner of the back cover is protruding inwardly with the thickness corresponding to the connecting edge panel for the front and back covers. As shown from FIGS. 1A to 1D, the amplifier is connected with the back cover as a whole, including a shell body 71 serving the function as a speaker, an ordinary circuit for amplifying the sound signal and a larger speaker insider the shell body. The amplifier connected with the circuit board 90 through connecting cables can play the sound signals in the PDA for the listeners. In order to avoid interference between the information booklets in the front cover and the amplifier, the shape of the information booklets accords with that of the connecting part of the amplifier 70. In the present embodiment, the connecting part is arc-shaped. Magnets 111 and 112 are placed correspondingly to the amplifier so that the front and back covers can be attracted to each other by the magnetic force.

Embodiment 2

Figure 3A:
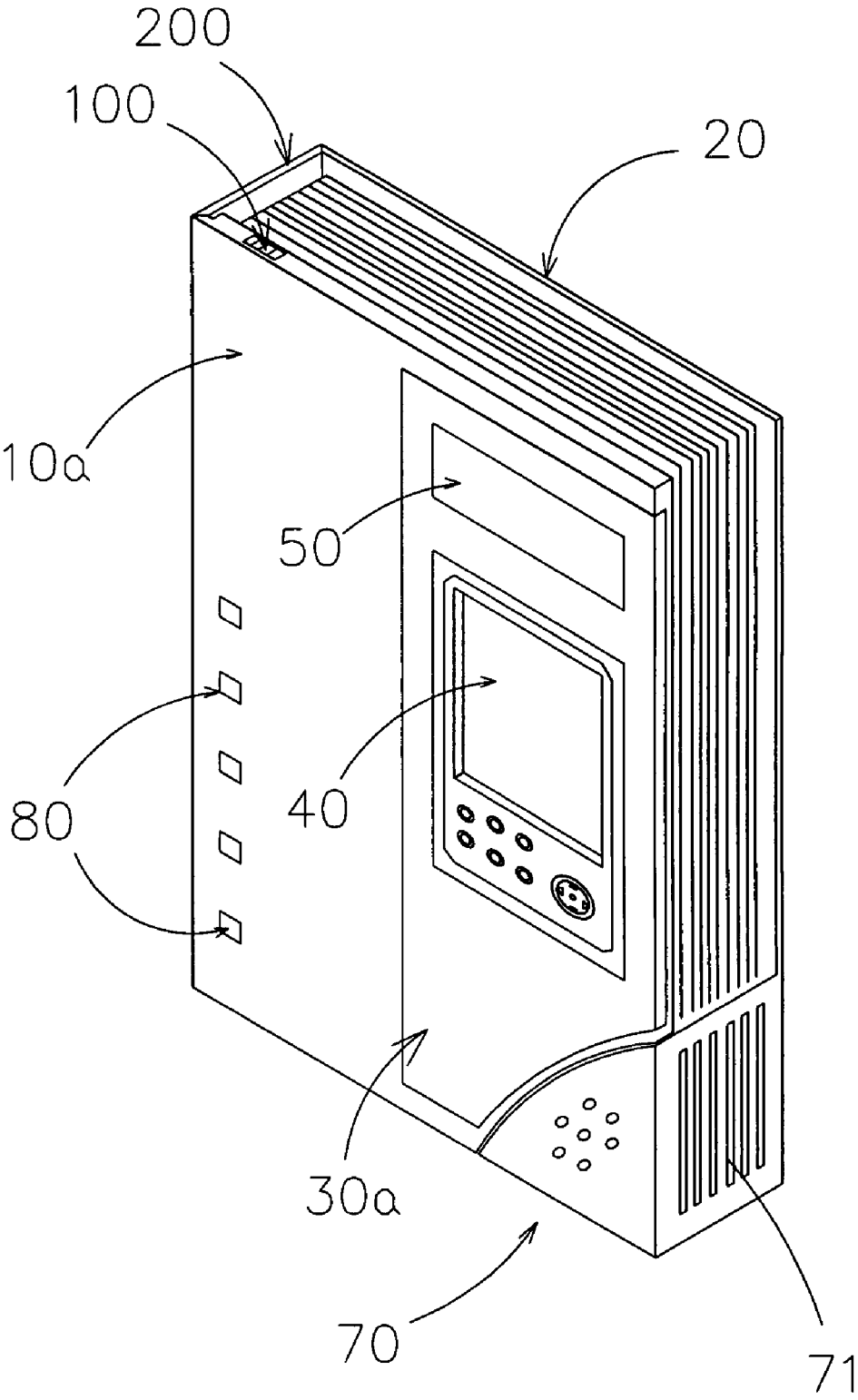
FIG. 3A is a schematic representation of the outer main body.
Figure 3B:
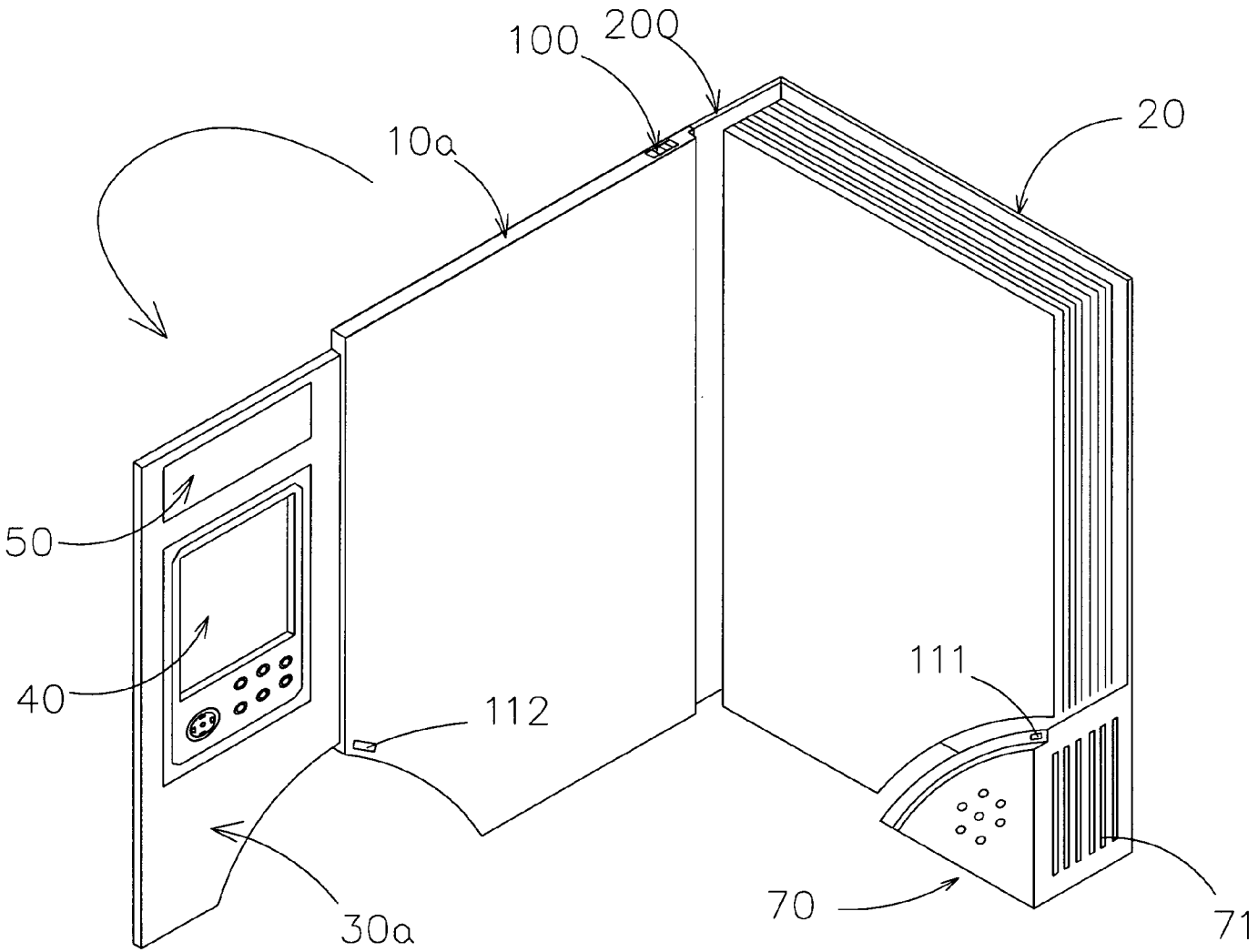
FIG. 3B is a three-dimension schematic representation when the accessory panel is pulled out.

Referring to FIGS. 3A and 3B, the basic structure of the present embodiment is identical to the embodiment 1 and the only difference is that the rotatable accessory panel 30*a* is located at external side of the front cover 10*a*.

Embodiment 3

Figure 4A:
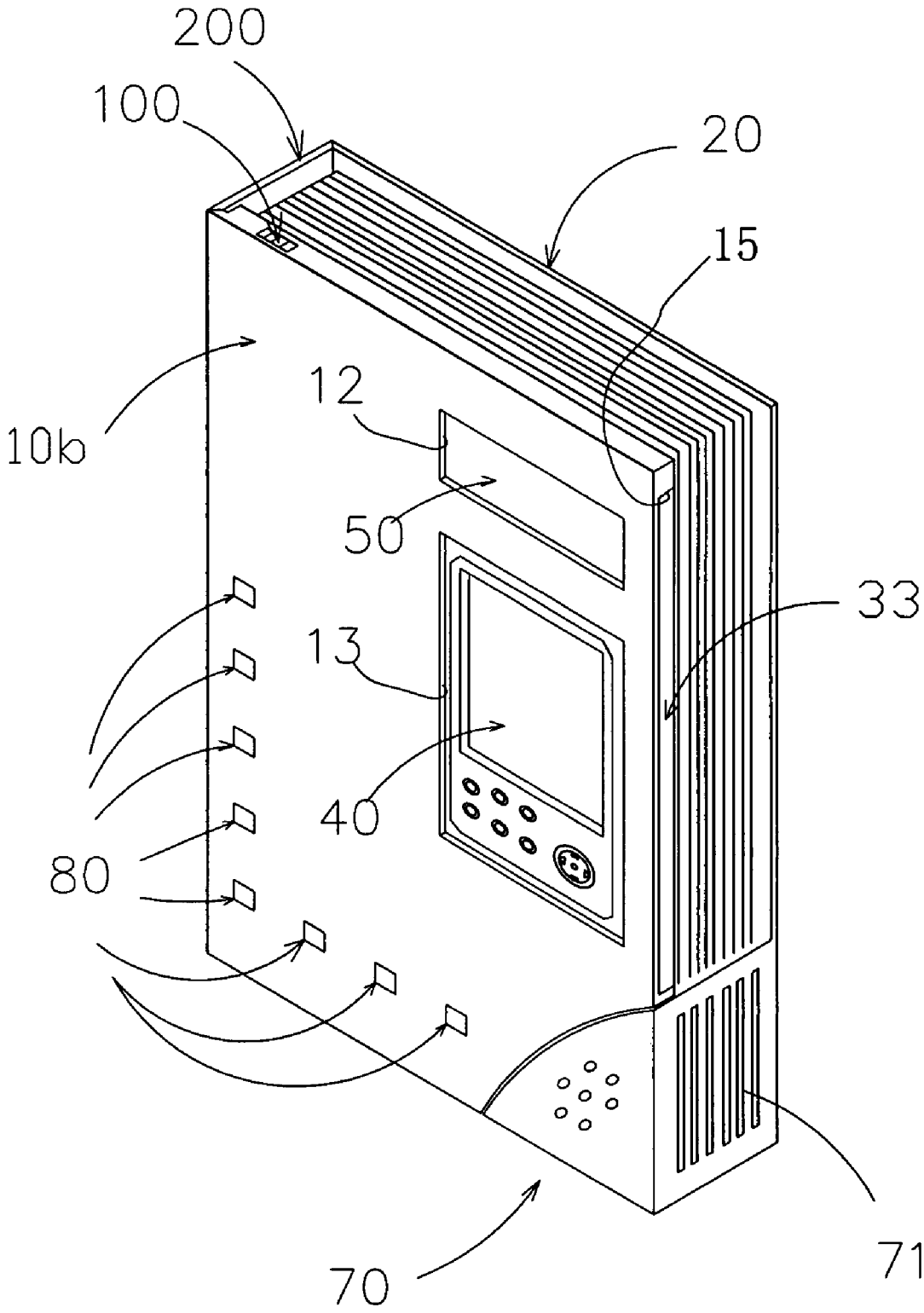
FIG. 4A is a schematic representation of the outer main body.
Figure 4B:
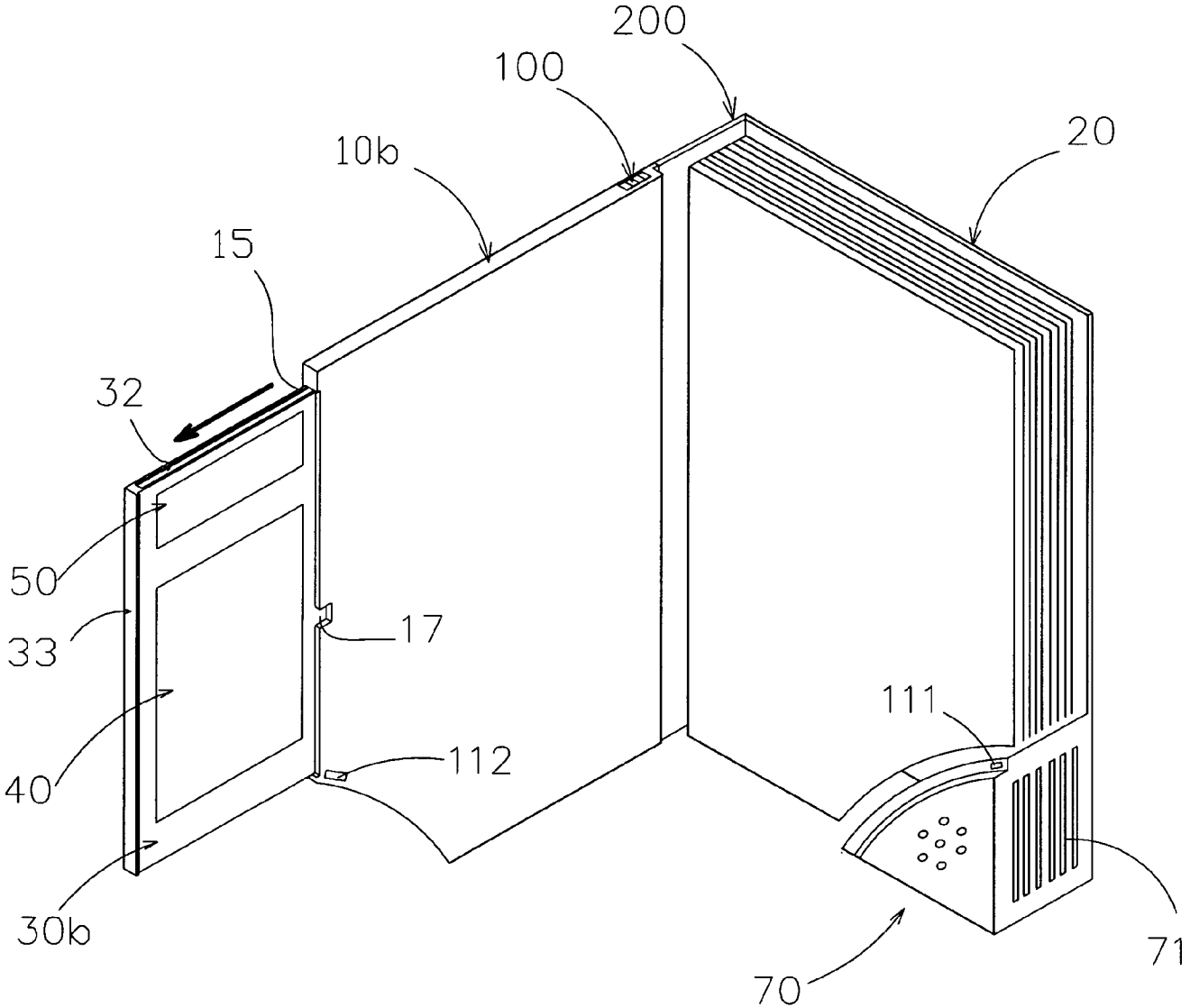
FIG. 4B is a three-dimension schematic representation when the accessory panel is pulled out.
Figure 5D:
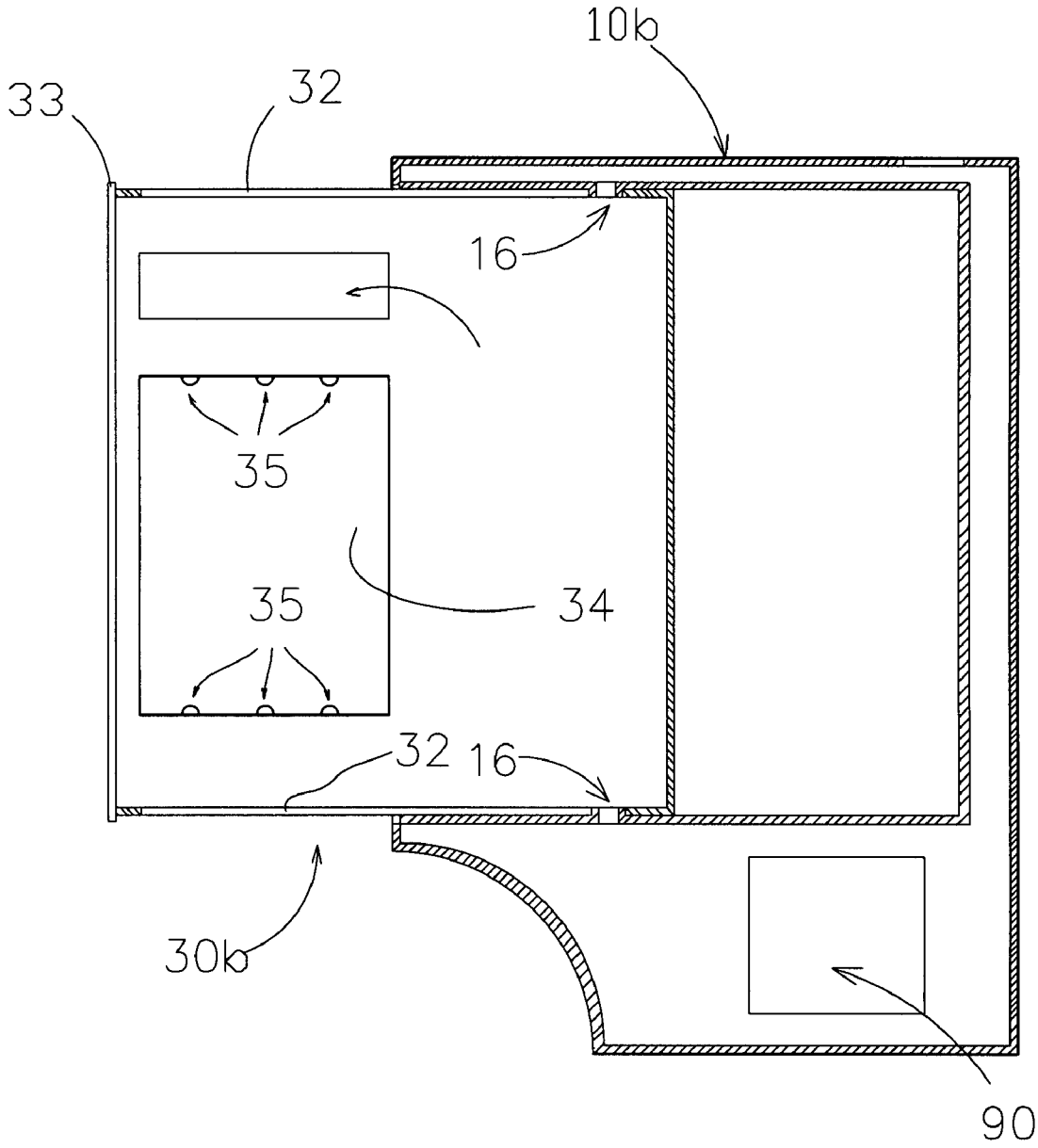
FIG. 5D is a schematic representation when the accessory panel is pulled out.

In this embodiment, a multifunctional cover device for PDAs with an accessory panel which can be pushed-in and pulled-out is illustrated. The basic structure of the present embodiment is identical to the embodiment 1 and the only difference is that the accessory panel can be pushed-in and pulled-out. As shown in FIG. 4, the push-and-pull accessory panel 30*b* is located at the push-and-pull cavity inside the front cover 10*b*. The structure of the pull-and-push accessory panel is shown in FIG. 5A, wherein an accessory panel opening 15 is located at one side or a plurality of sides of the front cover 10*b*, and the accessory panel 30*b* can be pulled out, and thus forms an extendable front cover board, as shown in FIGS. 4B to 4E and 5D) and the accessory panel can be restored to the front cover 10*b*, as shown in FIGS. 4A and 5C. As shown in FIG. 5B, two position columns 16 with through holes are each placed at the upper and lower lateral wall in the inner chamber of the front cover 10*b*. The position columns are used to limit the extension position of the accessory panel 30*a* so that the accessory panel would not fall out from the front cover. Two elongated grooves corresponding to the position columns are located at the top and the bottom rims of the accessory panel 30*b*, wherein the position column 16 is put into the elongated groove 32 so that the accessory panel can be freely pushed-in or pulled-out. A protruding column 33 is located at the rim of the extension side of the accessory panel 30*b* so that the position of the accessory panel can be limited. The accessory panel opening 15 is at one side of the front cover 10*a*, wherein an indenture 17 for fingers is at the exit of the accessory panel. The accessory panel 30*b* can be pulled out to form an extendable front cover panel, as shown in FIG. 5D, and can be restored inside the front cover 10*b* after use, as shown in FIG. 5C. The structure of the pulled-out accessory panel 30*b* is shown in FIG. 4.

What is claimed is:

1. A multifunctional cover device, comprising a hollow front cover having a push-and-pull cavity and a back cover, wherein at least one pull-and-push accessory panel is movably mounted at said front cover within said push-and-pull cavity, wherein said front cover further has one or more panel openings formed at one or more edges of said front cover such that said accessory panel is slidably pulled out from said push-and-pull cavity through said panel opening to form an extendable front cover and to be pushed into said push-and-pull cavity to restore said accessory panel into said front cover, wherein said accessory panel has a lighting lamp and a PDA detachable device, wherein said front cover further has two windows arranged in such a manner that when said accessory panel is pushed into said push-and-pull cavity, said lighting lamp and said PDA detachable device are aligned with said windows respectively.

2. The PDA detachable multifunctional cover device, as recited in claim 1, wherein a position column is provided at each of upper and lower lateral walls of said push-and-pull cavity of said front cover, wherein an elongated groove is provided at each of top and bottom edges of said accessory panel to engage with said position column such that said position column limits a further extension of said accessory panel when said accessory panel is pulled out from said push-and-pull cavity, wherein a protruding column is formed at a corresponding edge of said accessory panel to be pulled and an indenture is provided at said front cover at an edge of said panel opening thereof for accessory panel being pulled out from said push-and-pull cavity of said front cover.

3. The multifunctional cover device, as recited in 1, wherein said back cover, having a hollow and planar shape, comprises an amplifier mounted at a corner of said back cover and electrically connected to a battery set, wherein a thickness of said amplifier is corresponding to a width of a connecting edge panel which is extended between said front and back cover, wherein a shape of said amplifier accords with shape of an information booklet mounted between said front and back covers, wherein magnetic pieces are mounted on said front cover and said amplifier respectively for magnetic attraction between said front cover and said amplifier.

4. The multifunctional cover device, as recited in 1, wherein a plurality of decorative illuminators are placed on an outer surface on said front cover and are connected to a circuit board which is connected to a battery set, wherein said circuit board is supported by said front cover and provides computer hubs for connecting computers to said circuit board.

5. The multifunctional cover device, as recited in 1, wherein the accessory panel has a through window, wherein at least two sets of retractable metal connecting columns are provided at an upper and lower lateral walls of said through window of said accessory panel respectively, wherein at least two connecting holes are provided at upper and lower edges of PDA device for said metal connecting columns plugging into said connecting holes respectively so that said PDA device is detachably mounted within said through window of said accessory panel.

6. The multifunctional cover device, as recited in claim 5, wherein each of said metal connecting columns comprises two column sections and a supporting board connecting between said column sections, wherein two or more column seats, each having a seating hole, are mounted at a peripheral side of said through window, wherein one of said column sections is slidably disposed at said seating hole while another said column section is slidably disposed in a column hole provided at an inner frame mounted to said through window, wherein a spring is in said seating hole to bias against said supporting board towards said inner frame so as to push a portion of said respective column section out of said column hole, such that said column sections of said metal connecting column are freely moved at said seating hole and said column hole to selectively retract said portion of said column section back to said column hole.

* * * * *